United States Patent [19]

Jenkins et al.

[11] 4,270,552

[45] Jun. 2, 1981

[54] PROCESS AND APPARATUS FOR PRODUCING PAPER RECONSTITUTED TOBACCO

[75] Inventors: John M. Jenkins, High Wycombe; Christopher T. Pedder, Tottington; Neil G. D. Robertson, Marlow Bottom, all of England

[73] Assignee: Brown & Williamson Tobacco Corporation, Louisville, Ky.

[21] Appl. No.: 58,971

[22] Filed: Jul. 20, 1979

Related U.S. Application Data

[63] Continuation-in-part of Ser. No. 839,309, Oct. 4, 1977, abandoned.

[51] Int. Cl.[3] ..... A24B 3/14; A24B 3/18; A24B 15/24

[52] U.S. Cl. ..... 131/290; 131/374

[58] Field of Search ..... 131/17, 120, 140 C, 131/143, 2, 133 R, 134, 135, 136

[56] References Cited

U.S. PATENT DOCUMENTS

| | | | |
|---|---|---|---|
| 80,248 | 10/1805 | Wimmer | 131/143 |
| 304,255 | 7/1862 | Rosenberg et al. | 131/140 C |
| 314,571 | 8/1864 | Osborne et al. | 131/17 AE |
| 408,337 | 4/1878 | Berenger et al. | 131/2 |

FOREIGN PATENT DOCUMENTS

| | | | |
|---|---|---|---|
| 25830 | of 1803 | United Kingdom | 131/140 C |

*Primary Examiner*—Vincent Millin

*Attorney, Agent, or Firm*—Charles G. Lamb; William J. Mason

[57] ABSTRACT

A process and apparatus for producing reconstituted tobacco by a papermaking process. Tobacco material is mixed with aqueous tobacco extract or water to wet the tobacco, the resulting slurry is fed to a deflaker in which the bundles of tobacco fibers are reduced to small fiber bundles. The slurry is then directed to an extraction stage after which the water soluble and fibrous components of the slurry are separated. The fibrous material in the form of a slurry is preferably passed through a second deflaker to further separate the fiber bundles and through refiners to prepare the material for web formation. The fibrous material is diluted and passed to a papermaking machine in which it is processed to form a base sheet of reconstituted tobacco and the sheet is impregnated with a concentrate of the water soluble component separated at the extraction stage. The latter component may be subjected to a high shearing force to lessen its viscosity and facilitate the impregnation process.

24 Claims, 4 Drawing Figures

PROCESS AND APPARATUS FOR PRODUCING PAPER RECONSTITUTED TOBACCO

CROSS-REFERENCE TO RELATED APPLICATIONS

This application is a continuation-in-part of Application Ser. No. 839,309, filed Oct. 4, 1977, now abandoned.

BACKGROUND OF THE INVENTION

Reconstituted tobacco is of important commercial significance today for economic and other reasons and is commonly used in the manufacture of cigarettes and similar smoking articles. Reconstituted tobacco comprises primarily tobacco pieces too small for use in regular manufacture of cigarettes, referred to as waste or scrap tobacco, formed into a sheet which can be handled and utilized in cigarette manufacture in a similar manner to hold tobacco leaf. Differences resulting from structural modification may also make it desirable to reconstitute tobacco leaf.

There are basically two commonly known, commercially employed, processes for preparing reconstituted tobacco. One employs a slurry, of finely divided tobacco parts and a binder, which is cast onto a steel band and then dried. After drying, the sheet is shredded and used as a cigarette filler. The second commonly known process employs papermaking techniques and does not require the addition of a binder.

Several recent examples of processes which have been developed for forming reconstituted tobacco, particularly by the papermaking process, are disclosed in U.S. Pat. Nos. 3,428,053; 3,415,253; 3,561,451; 3,467,109; 3,483,874; 3,870,054; 3,860,012 and 3,847,164 and U.K. Patent Nos. 1,194,477; 1,230,576; 1,171,878; 1,372,510; 1,342,029; 1,341,069 and 1,365,087.

SUMMARY OF THE INVENTION

This invention concerns a process and apparatus for producing reconstituted tobacco by a papermaking process. Briefly, in the process according to the invention, tobacco material is mixed with aqueous tobacco extract or water to wet the tobacco, the resulting slurry is fed to a peg-mill deflaker in which the bundles of tobacco fibers are reduced to small fiber bundles, the slurry is then directed to an extraction stage after which the water soluble and fibrous components of the slurry are separated, the fibrous material in the form of a slurry is preferably passed through a second peg-mill deflaker to further separate the fiber bundles and through refiners to prepare the material for web formation, the fibrous material is diluted and passed to a papermaking machine in which it is processed to form a base sheet of reconstituted tobacco and the sheet is impregnated with a concentrate of the water soluble component separated at the extraction stage. The latter component may be subjected to a high shearing force to lessen its viscosity and facilitate the impregnation process.

It is an object of the present invention to provide an improved process and apparatus for forming reconstituted tobacco by a papermaking process. While the invention will be described in terms of waste tobacco, it also provides means for the processing of stem and lamina of whole leaf, separately or in combination. As used here, the term "fibrous material" refers not only to insoluble material derived from the midrib and veins of tobacco leaf but also to aggregates of lamina cells.

In the present process, more specifically, tobacco material is mixed with aqueous tobacco extract (initially with a predetermined amount of water) to permit the desired mixing and wetting of the material. The resultant slurry is fed into a peg-mill deflaker which is utilized to reduce the tobacco to coarse fiber bundles. The slurry is then directed to an extraction stage where the water soluble and fibrous components of the slurry are separated. The process may be further improved by rediluting the fibrous component with water to form a slurry which is fed to a second peg-mill deflaker to reduce the cross-section of the bundles without substantially reducing their length. Alternatively a second peg-mill deflaker may be located before the extraction stage to facilitate extraction of the solubles. Advantageously the slurry is next passed through refining means to separate the fiber bundles further and especially to promote fibrillation. This slurry, further diluted, is passed to a papermaking machine where a web of the fibrous material is formed on a foraminous support with the removal of water by drainage and suction. Further water may be removed by pressing and drying to form a base sheet. The base sheet is impregnated with a concentrate of the water soluble components separated at the extraction stage. The resultant product is a reconstituted tobacco of good quality produced in an efficient and economic manner.

Advantageously, for achieving a more efficient extraction operation, the extraction stage employs multiple separate extractors in a multiple-stage counter-current extraction system which incorporates interstage soaking. Advantageously also the concentrated extract, which may contain very fine water insoluble materials, may be reduced in viscosity by being subjected to high shear before impregnation of the base sheet.

By way of example, one manner of carrying the invention into effect will now be more fully described with reference to the accompanying diagrammatic drawings.

DETAILED DESCRIPTION

Figure 1:
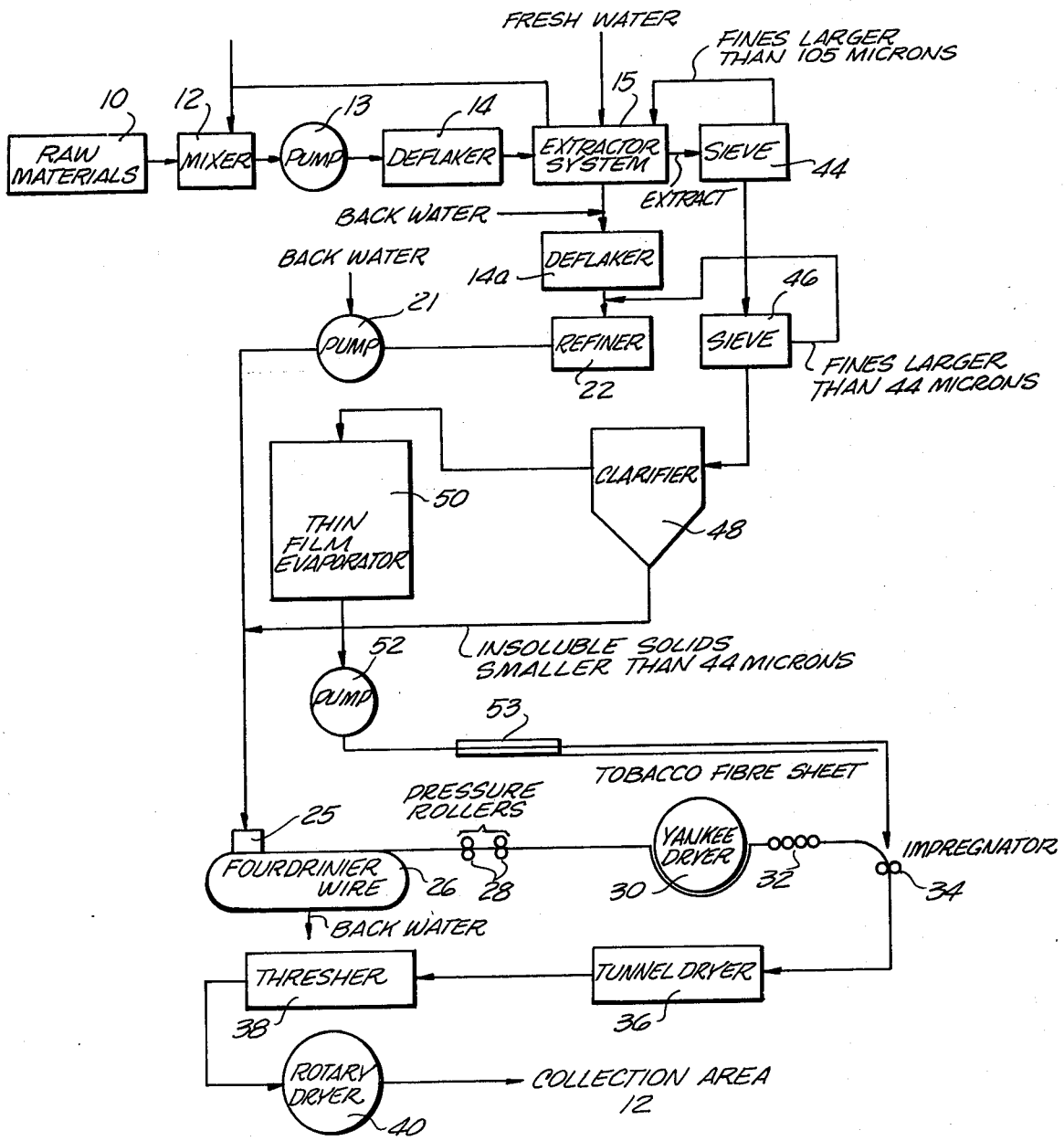
FIG. 1 is a block diagram for the process generally.

Tobacco raw materials 10 and a predetermined quantity of water are introduced into a mixer 12, which may be a large tank with a rotating member for thoroughly mixing the raw materials and the water. The process is started with fresh water, but, in continuous operation, extract from subsequent process stages is used. The tobacco slurry produced is diluted initially by a 15% by weight total solids content, which is commonly 7% fiber and 8% water solubles. In operational equilibrium, the solids content increases to 19%, which is 7% fibers and 12% dissolved solids.

The mixture is retained in the tank 12 for approximately twenty minutes, during which it is thoroughly mixed. After the mixing, the slurry is pumped to a peg-mill deflaker 14 by a pump 13. A lobe pump has been found to work effectively because it will pump pieces of stem, without comminution prior to the mixing, thus maintaining the fiber-bundle length for the deflaker.

The deflaker 14 reduces the tobacco into coarse bundles of fibers to facilitate subsequent handling and extraction. The deflaker is operated in such a way that it preferentially reduces the cross section of the fiber bundles relatively to their length in order to produce a reconstituted tobacco of good strength, especially from a slurry of low stem content. A deflaker including a peg-mill deflaker, is conventionally used in papermaking to separate aggregates of cellulosic fibers or flakes into individual fibers. In the case of tobacco, where the fibers are present in the form of naturally occurring bundles, we have found that the operation of the deflaker must be made such as to produce a slurry containing fiber bundles of small diameter, rather than individually separated fibers. Individual fibers would adversely affect extraction and would result in poor draining of the web on the wire of the papermaking machine and a dense base sheet difficult to impregnate. Under the equilibrium conditions, a peg-mill deflaker achieves the properties required for subsequent treatment.

Figure 3:
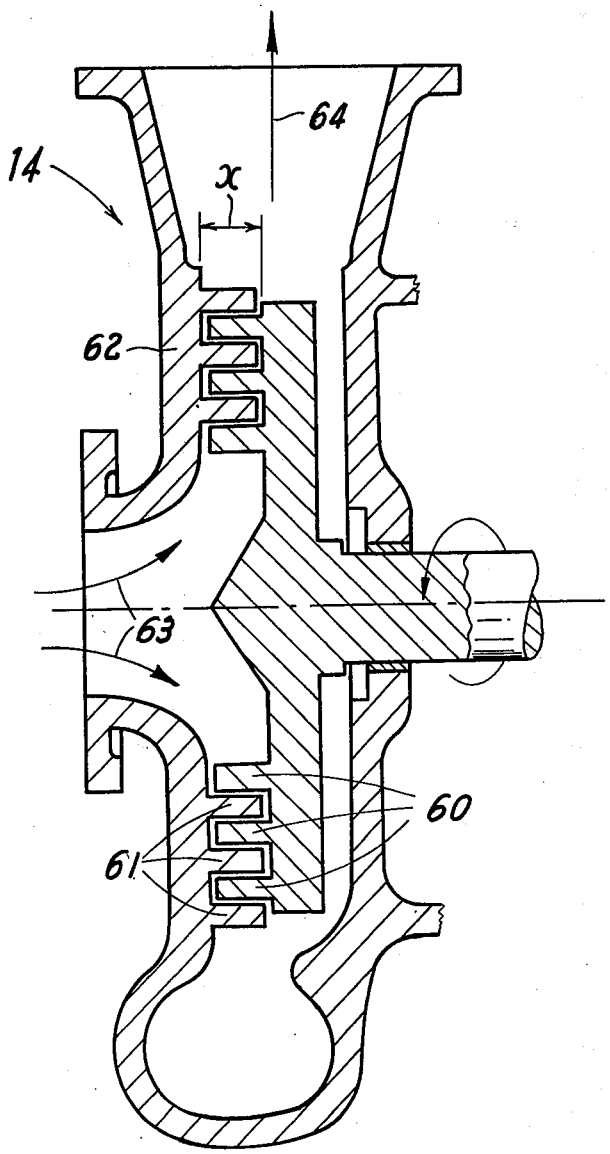
FIG. 3 is a view in diagrammatic axial section of parts of a preferred deflaker of the present invention; and, FIG. 4 is a diagrammatic view illustrating the rings of the deflaker of FIG. 3 separated axially and showing the ring in side view (only the half of each ring being shown).
Figure 4:
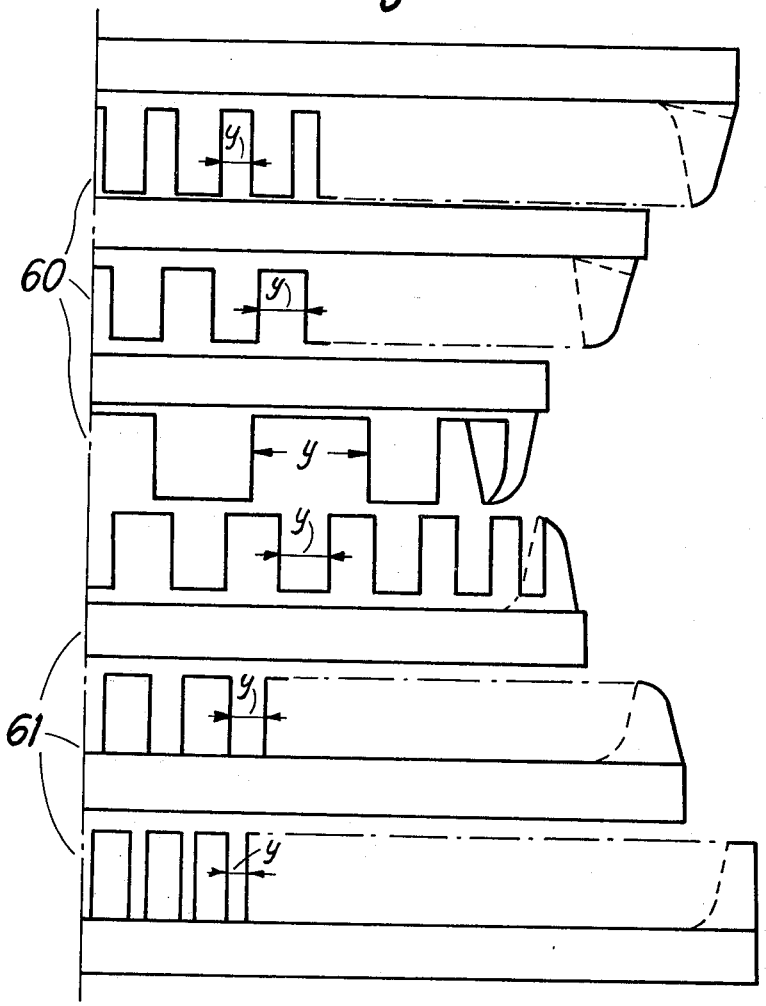

In general, a preferred type of deflaker as best seen in FIGS. 3 and 4 consists of alternate rotating and stationary rings 60,61 of teeth or pegs within a housing 62. In FIG. 4, the rings 60 and the rings 61 (half rings only being illustrated) are shown diagrammatically as though separated in the direction of the axis of rotation C/L of the deflaker. The shapes of the teeth of the individual rings have been indicated for the extreme right-hand tooth of each ring. It will be seen that, in the operative assembled condition, the three rotary rings 60 will nest one within another and the three stationary rings 61 one within another, while the teeth of the outermost rotary ring will rotate between the outermost and the intermediate stationary rings of teeth, the intermediate rotary ring between the intermediate and inner stationary rings and the inner rotary ring within the teeth of the inner stationary rings. The clearance between the rotor and stator rings is shown at x in FIG. 3. The inter-tooth or gap dimension for each of the rings 60 and 61 is indicated at y for each ring in FIG. 4. An acceptable deflaker, which can be used in the present process, is of the type manufactured by Escher Wyss GmbH of Ravensburg, West Germany. The clearance x has a fixed value of about 15 mm. The dimension y for the outermost of the rings is typically 3.5 mm. Several different sizes of deflaker can be effectively employed, for example one which operates at 3000 revolutions (50 Hz power supply) to 3600 revolutions per minute (60 Hz) or one which operates at 1500 revolutions (50 Hz) to 1800 revolutions per minute (60 Hz). Corresponding rings of these different deflakers have diameters such that their tangential volocities are similar and therefore the deflaking effects and specific power consumptions are similar. When the smaller deflaker, operating at 3000 or 3600 revolutions per minute, is used for operating on paper stock, the maximum power of the driving motor is 55 kw. For the purpose of the present process, a motor of higher power, 76 kw, is employed.

In the conventional use of deflakers for papermaking, the cellulosic materials have always been subjected to some previous disintegration treatment, such as pulping, so that the aggregates of cellulosic fibres have dimensions that are shorter than x and narrower than the smallest inter-tooth dimension y. In the present use, some of the stem constituent of the tobacco raw material is longer than x and wider than y.

A reduction in the size of the dimension y would result in a greater reduction in fibre-bundle size in the deflaker 14, but it is likely that the power consumption would become excessive. Straight rather than curved teeth could be used in the deflaker 14 but it has been found that the use of curved teeth prevents blockages that sometimes occur when using rings of straight teeth in the deflaker.

In our process, the tobacco slurry is fed axially to the deflaker 14. The first encountered rotor ring accelerates and impacts the material against the teeth of the adjacent stator ring. On leaving slots in the latter, the slurry is again accelerated and impacted against the second rotor ring. This process is repeated in a third stage and the slurry finally emerges from the stator and is discharged radially from the deflaker. The tobacco slurry from the deflaker is suitable for subsequent pumping, extraction, fine deflaking and refining. The action of the deflaker on the slurry, which contains naturally occurring coarse bundles of fibers, is to reduce larger tobacco pieces to fiber bundles of about 10 to 20 mm in length and to reduce their cross-section to about 2 mm or less. Any material that is below 10 mm is barely reduced in length by passing through the deflaker, so that very little unusable fines are generated in it.

The tobacco slurry is fed to the deflaker 14 at a rate of 200 to 300 liters per minute for the deflaker operating at 3000 to 3600 revolutions per minute, or 400 to 500 liters per minute for the deflaker operating at 1500 to 1800 revolutions per minute. These flow rates would be unsuitable for the deflaker's normal use in a papermaking process, because severe cavitation could occur with paper stocks, with resultant damage to the deflaker. This does not occur with tobacco slurry.

After extraction, as hereinafter described, of water solubles and separation in an extraction system 15, the fibrous component is reslurried with water which has drained through the Fourdrinier wire of a papermaking machine 26, commonly known as "back water", and is passed to a second deflaker **14*a*. The second deflaker uses a set of rings (Escher Wyss type A18) with the narrowest teeth and gaps y available. Typically the dimension y for the outermost ring is 1 mm. The function of this deflaker is to reduce the coarse bundles of fiber from the first deflaker 14 to fine bundles suitable for subsequent refining. It is especially important that any flat pieces of stems, present after the first deflaking, are reduced to small fiber bundles. Flat pieces of stem are undesirable for subsequent refining because they tend to be chopped into lumps. These lumps would block the forming aperture of the head box of the machine 26**, contribute nothing to sheet strength and be torn out of the sheet on drying cylinders, for example, and could not be effectively impregnated with tobacco extract liquor.

The action of the two peg-mill deflakers 14 and **14*a*, together with the extraction of the solubles, converts the fibrous component to a state most suitable for subsequent refining and web formation. At the outlet of the second deflaker 14*a***, the tobacco slurry consists of fiber bundles of average 10 mm length and 1.3 $mm^2$ cross-sectional area together with smaller pieces which have passed through the deflakers substantially unchanged in dimension.

The proportions of these two components are dependent on the form of the tobacco materials subjected to the process. The use of the two deflakers has shown a 25% increase in breaking length and a 50% increase in reconstituted tobacco sheet strength, as compared with more complex refining treatments which use up to five treatment stages.

The tensile and tear strength of the reconstituted base web, while still wet, have an important effect on machine runability. Development of wet base web strength requires the longest fibers possible consistently with good web formation. A substantial increase in strength and machine runability is achieved by using the peg-mill deflakers in place of other known means. The increase in strength permits the attainment of better production efficiency while using tobacco materials of low stem content. For example, it permits the formation of sheet of suitable strength from natural leaf, which normally contains about 25–33% stem, without the addition of other cellulosic fibers, such as wood or flax.

The tobacco material is rendered more open and fibrous in nature by using two peg-mill deflakers. The resultant open base web subsequently produced from it becomes impregnated, rather than coated with the tobacco extract. Impregnated reconstituted tobacco is preferable because the tobacco pieces are less likely to stick together during subsequent manufacture of tobacco articles.

The second deflaker 14*a* may alternatively be disposed, in series with the first, upstream of the extraction system 15.

The system 15 with the tank 12 may be described as a three-stage countercurrent extraction system. In countercurrent extraction, the material to be extracted, namely the fibrous tobacco material, goes through the extractors in series from first to last. Fresh water is introduced at the last extractor and, upon extraction, flows to the previous extractor. This counterflow of the water is repeated until the water containing the solubles leaves the system at the first stage.

Figure 2:
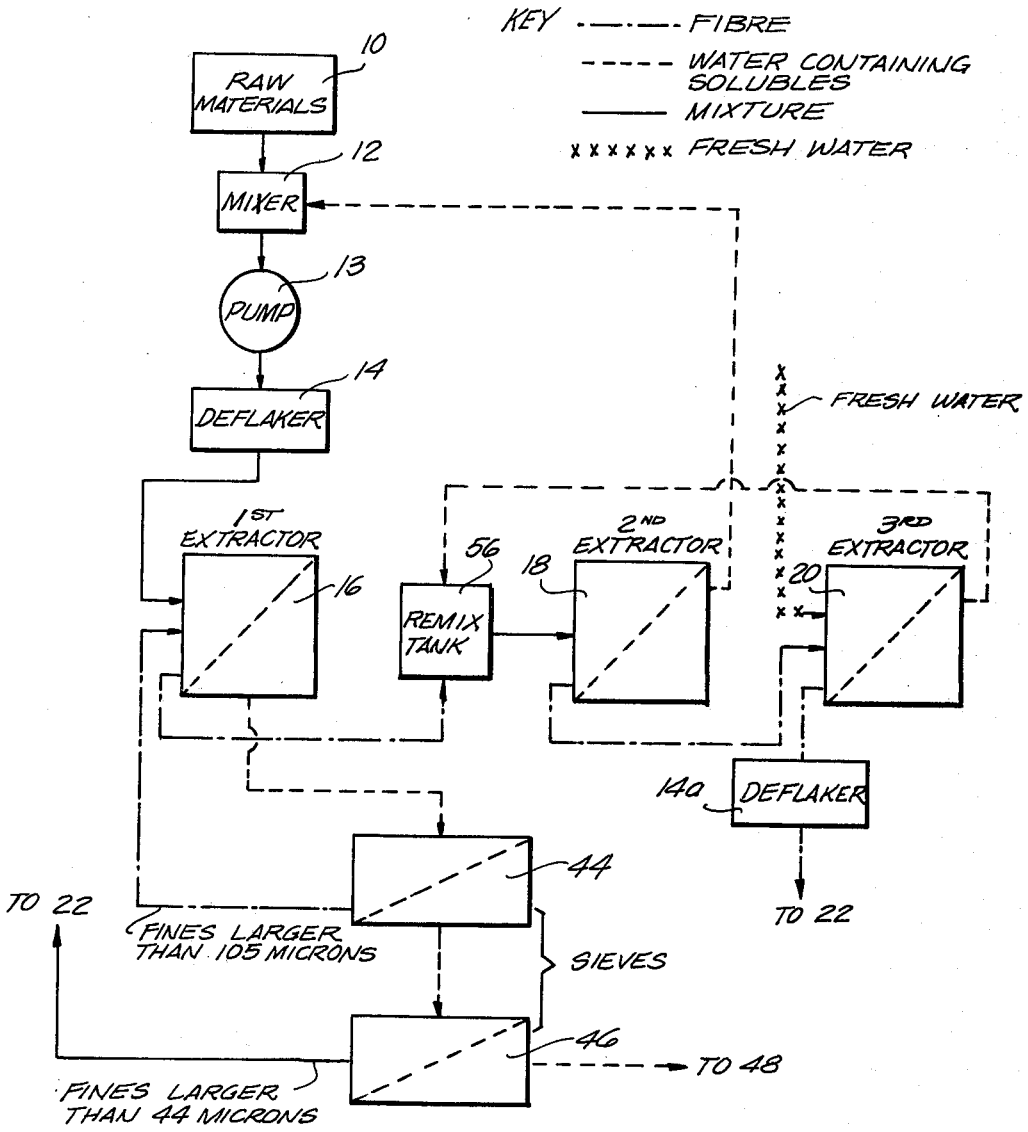
FIG. 2 is a block diagram for the extraction portion thereof.

The use of simple repeated extraction, for example in a three-stage extractor, would produce about three times the volume of water to be evaporated as is obtained from a three-stage countercurrent extractor. Consequently, without countercurrent extraction, bigger evaporators, more evaporator stages, higher steam costs and greater exposure of the extract to heat during concentration would be involved. With countercurrent extraction, only one small evaporator is needed and lower steam costs and lower said heat exposure are possible. In our process, this countercurrent extraction principle has been advantageously extended to include the initial slurry of the tobacco material in the tank 12 and the deflaking means in the first extraction stage, as shown in FIG. 2.

The peg-mill deflaker 14 has three effects which assist in the water extraction stage. Stems are split along their length into slender fiber bundles, thus making access to the solubles easier. Intense turbulence within the deflaker 14 assists the water in entering the capillary passages in the fibers and so dissolving the solubles. The deflaker 14 allows correctly sized and undersized pieces to pass through almost completely unchanged. When the tobacco slurry is passed into a first screw press extractor 16 (FIG. 2), it is advantageous that the longer slender fiber bundles dewater rapidly and form a strong filter network. This network retains within the extractor 16 finer tobacco pieces which are smaller than the holes in the extractor screen. Any small particles entrained in the extract are recovered by rotary, vibrating, sieves 44 and 46. Fines from sieve 44 are recycled to the extractor 16; the fines from sieve 46 are added, prior to refining, to the extracted fibrous material leaving the extraction system. Further fines are removed by a clarifier 48, and returned to the refined material. The partially extracted material is continuously fed to a second screw-press extractor 18. The material thus further extracted is passed to a third screw press extractor 20.

Screw-press extraction is preferred for the three stages 16, 18 and 20. Screw-press extractors remove the extract from the solid material by moving the latter, by means of a rotating screw feeder, through a conical section of progressively decreasing cross-section having perforated walls which typically have holes of 1.5 mm diameter. However, centrifugal extractors could be used in the extraction stage in place of or in combination with screw-presses.

During extraction, the temperature of the slurry is maintained between 20° and 30° C. At lower temperatures, extraction efficiency materially decreases. At higher temperatures, the fibers swell and soften, making removal of the extract difficult, and microbiological degredation of the tobacco may occur.

It is desirable to remove as much as possible of the water soluble material during this extraction phase and to retain it for the subsequent addition to the base sheet. This minimizes loss of water soluble components at later stages of processing and overcomes contamination and corrosion problems associated with forming the base sheet. There are also other reasons, such as the possibility of mold formation, which make it desirable to remove as much of the soluble material as possible from the solids prior to base sheet information. In addition, if any substantial amount of soluble material is retained with the fibrous material, the subsequently formed sheet tends to adhere to various pieces of processing equipment, such as drying cylinders.

The treatment of the water soluble extract separated from the fibrous component at the extraction stage 15 will be discussed below.

After the extraction, the fibrous material, in the form of a slurry, after treatment in the peg-mill deflaker 14*a*, as previously described, is passed to a refiner 22. One or more refiners of disc type, such as are employed in papermaking, may be used.

After refining, the slurry is further diluted with back water, in a centrifugal pump 21 (FIG. 1), to a consistency of about 1% by weight. This diluted slurry is passed to the head box 25 of the papermaking machine, from which box it is deposited on the moving foraminous belt 26, known as the Fourdrinier wire, of the machine. The wire moves at a constant speed and a large proportion of the water associated with the deposited fiber drains through it. A plurality of suction devices (not shown) remove further water from the material on the wire.

As the moisture level of the web of fibrous material is high at the end of the wire, a felt belt is pressed down upon the material, the web adhering to the underside of the belt by surface tension. A second felt belt then comes into contact with the underside of the web, so that the web is sandwiched between the two belts. While thus sandwiched, the web passes through two sets of pressure and suction rollers 28, where moisture is squeezed and drawn from it. The moisture level of the web prior to entry into this roller section is approximately 90% by weight. Upon exit, the moisture level is about 72% by weight. The web is next transferred from the belts to a conventional piece of papermaking equipment 30 known as a Yankee dryer. This is a large rotating cylinder heated to a surface temperature of approximately 120° C. Its axis is located below the level of the rollers 28 and the web is carried is against the underside.

Upon leaving dryer 30, the web, then at a moisture content of 50 to 60% by weight, is conveyed over a series of drum dryers 32, as shown four dryers, which reduce the moisture content to about 30%. The web is then directed vertically downwards between two horizontally opposed pressure rollers 34 which serve as impregnator. At the rollers 34, the web is impregnated with a concentrated extract obtained, as hereinafter described, by subsequent processing of the extract from the extraction stage 15, the extract being obsorbed by the web as it passes between the rollers. The moisture content of the web is thereby increased to approximately 45%.

Thereafter, the web is conveyed through a conventional, arched, tunnel dryer 36 in which it is supported by air to prevent sticking to the conveyor. The dried web, then at a moisture content of 17 to 20% by weight, is passed to a conventional threshing machine 38. Subsequent to threshing, the web may be further dried in a rotary dryer 40. Finally the reconstituted tobacco web, having a moisture content of 10 to 15%, is conveyed to a collection area 42 for packaging.

Reverting to FIG. 2, the extract collected at the first extractor 16 is passed in succession through the sieve 44 and a sieve 46, which remove some of the suspended solids. Fines from the sieve 44 which are above 105 microns in size are recovered and fed back into the extractor 16, as is the slurry from the deflaker 14. After passing through the sieve 44, the extract is passed through the sieve 46, where material less than 105 microns and greater than about 44 microns is recovered and added, prior to refining, to the extracted fibrous material leaving the extraction system. Any insoluble material finer than about 44 microns passes with the extract, containing about 10–12% solubles, to the clarifier 48 (FIG. 1).

The clarifier 48 which may be a conventional solids-ejecting centrifuge, serves to remove any fine water insoluble. material present in the extract. Separation of these fines facilitates concentration of the extract and subsequent impregnation of the web. The solid material recovered from the clarifier is returned to the refined material for web formation.

The extract is concentrated by evaporation in a thin-film evaporator 50 under reduced pressure. After concentration the extract has a concentration of about 50% by weight dissolved solids. The viscosity of the concentrated extract may be too high for efficient impregnation of the web. As high shearing forces will produce a temporary reduction in viscosity, the extract is subjected to high shear by being passed through a narrow-bore pipe 53 (FIG. 1) by a pump 52 prior to the impregnation of the tobacco web. The viscosity of the concentrated extract may vary with the type of tobacco raw material used and provision may be made for bypassing the pipe 53 if the viscosity of the concentrated extract is sufficiently low not to cause impregnation difficulty.

Advantageously, the solids from the first extractor 16, are held for approximately two minutes in a small remix tank 56 (FIG. 2), in which the extract from the third extractor 20 is mixed with the said solids. This mixing improves the overall extraction efficiency of the process. The slurry from the remix tank 56 is passed through the second extractor 18 the extract from which is fed back to the initial mixer 12. The solids from the extractor 18 are discharged into the third extractor 20.

Fresh water is fed into the third extractor 20 to contact the partially extracted tobacco solids and remove further water-soluble material. The solubles from the extractor 20 are passed to the tank 56. The insoluble fibrous material from the extractor 20, remixed with "back water", is passed to the second deflaker **14*a*** as indicated above.

Treatment of the material by peg-mill deflaking has been found to produce significant advantageous results. In particular, it is possible to process tobacco which has little or no stem to produce a physically acceptable reconstituted tobacco. The extraction stage of the process provides a means for increasing the concentration of the extracted tobacco solubles while at the same minimizing the retention of solubles in the fibrous component of the tobacco, as well as for increasing the yield of fibrous material by extending the countercurrent principle to include the initial slurrying of the tobacco material.

It is also of advantage to be able to reduce the viscosity of the concentrated extract, prior to the impregnation, without incurring disadvantages which would result from dilution. Reduction of the viscosity of the concentrated extract by high-shear action is effective in aiding impregnation of the web.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A process for producing reconstituted tobacco by a papermaking process comprising; mixing a predetermined amount of tobacco material with at least one of water and aqueous tobacco extract to wet the tobacco material, feeding the resulting slurry to at least one peg-mill deflaker in which the bundles of tobacco fibers are reduced to small fiber bundles, directing the slurry to an extraction stage, separating the water soluble and fibrous components of the slurry at the extraction stage, passing the fibrous material in the form of a slurry through a refining means to further separate the fiber bundles, diluting the fibrous material slurry and passing it to a papermaking machine, and processing the fibrous material in the papermaking machine to form a base sheet of reconstituted tobacco and impregnating the sheet with a concentrate of the water soluble component separated in the extraction stage.

2. The invention in accordance with claim 1 wherein the tobacco slurry initially mixed is diluted initially to a 15 percent by weight total solids content including 7 percent fiber and 8 percent water solubles and operating at equilibrium, the slurry has a solids content of 19 percent including 7 percent fibers and 12 percent dissolved solids, the mixture being retained in a vat for approximately 20 minutes in which it is thoroughly mixed.

3. The invention in accordance with claim 2 wherein the slurry is pumped to the deflaker by means of a lobe rotor pump, the deflaker acting on the fiber bundles to reduce the cross section relative to their length in order to produce a reconstituted tobacco of good strength.

4. The invention in accordance with claim 1 wherein the temperature of the slurry during the extraction stage is maintained between 20 degrees and 30 degrees centigrade.

5. The invention in accordance with claim 1 wherein the refining means is a disc mill including a plurality of rotating discs which further separates the fibers.

6. The invention in accordance with claim 1 wherein the fiber containing slurry received from the refining means to be passed to the papermaking machine is diluted with water to a consistency of about 1 percent by weight.

7. The invention in accordance with claim 1 wherein the diluted slurry passed to the papermaking machine is initially passed to the head box of the machine where the slurry is passed onto a moving foraminous belt moving at low speed to permit a large percentage of the water retained by the deposited fiber to drain out through the moving belt, suction members apply suction to remove further water from the fibrous mat on the belt, at the end of the belt a felt belt is pressed down upon the fibrous sheet, the sheet sticking to the underside of the felt belt, bringing a second felt belt into contact with the underside of the fiber sheet after the sheet passes from the belt thereby sandwiching the sheet between the two felt belts, passing the fiber sheet between the two felt belts through two sets of horizontal pressure rollers which squeeze moisture from the sheet so as to reduce the moisture level of the sheet from approximately 90 percent by weight to about 72 percent by weight, thereafter transferring the sheet from the felt belts to a first dryer in the form of a large, slowly rotating cylinder, heated to a surface temperature of approximately 120 degrees centigrade, the drum of the first dryer being depressed below the pressure rollers and the sheet moves beneath the first dryer drum thereby relieving some of the tension on the sheet, passing the sheet at a moisture content of 50 to 60 percent by weight through a series of further drums after it exits from the first dryer and has a reduced moisture content to about 30 percent and than downward between two opposed rollers where the sheet is impregnated with the concentrate obtained from the extractor system so that the sheet absorbs the extract as it passes through the rollers, thereby increasing the moisture content to approximately 45 percent, thereafter the sheet is moved sequentially through a tunnel dryer in which it is supported by air to prevent sticking and dried to a moisture content of 17 to 20 percent by weight, a threshing machine and a rotary dryer whereupon the dried reconstituted tobacco sheet having a moisture content of 10 to 15 percent is conveyed to a collection area for packaging.

8. The invention in accordance with claim 1 wherein the extractor stage includes three separate extractors.

9. The invention in accordance with claim 1 wherein the extractor stage includes three separate extractors of the type for removing extract from the solid material by moving the solid material by means of a rotating screw feeder through a conical section of progressively decreasing cross section having perforated walls.

10. The invention in accordance with claim 1 wherein the extractor stage includes three separate extractors, the extract from the first extractor being passed through two successive sieves for removal of some of the suspended solids therein, the solids from the first sieve being fed back into the first extractor along with the slurry from the deflaker, the extract which is passed through the second sieve removes material of smaller size than that removed in the first sieve and the material of smaller size being removed and, prior to refining, added to the extracted fibrous material leaving the extraction system.

11. The invention in accordance with claim 10 wherein the extract from the sieves is passed to a clarifier, where further fines are removed and the refined extract is returned to the refined material, the partially extracted material is continuously fed to a second extractor, and the material thus further extracted is passed to a third extractor.

12. The invention in accordance with claim 10 wherein the fines removed by the first sieve are above 105 microns in size, the material removed by the second sieve is less than about 105 microns and greater than about 44 microns.

13. The invention in accordance with claim 12 wherein the solids are removed from the first extractor and held in a remix tank for approximately two minutes, the extract from the third extractor being mixed with the solids from the first extractor in the remix tank prior to introduction to the second extractor, the slurry from the remix tank being passed through the second extractor, the extract from the second extractor being returned to be mixed with the predetermined amount of tobacco material introduced into the process before the deflaker, the solids from the second extractor being discharged to the third extractor, feeding fresh water into the third extractor to contact the partially extracted solids received from the second extractor to extract further extractable material.

14. The invention in accordance with claim 1 wherein the concentrate of the water soluble component separated in the extraction stage is subjected to a high shearing force to lessen its viscosity and facilitate the impregnation process.

15. The invention in accordance with claim 1 wherein two peg-mill deflakers are employed.

16. Apparatus for producing reconstituted tobacco by a papermaking process comprising; mixing means for mixing a predetermined amount of tobacco material with at least one of water and aqueous tobacco extract to wet the tobacco material, feed means for feeding the resulting slurry to at least one peg-mill deflaker in which the bundles of tobacco fibers are reduced to small fiber bundles, an extraction stage in communication with the deflaker for receiving the slurry therefrom and separating the water soluble and fibrous components of the slurry, refining means cooperating with the extraction stage to receive the fibrous material in the form of a slurry from the extraction stage and further separate the fiber bundles, means communicating with the refining means for diluting the fibrous material slurry received therefrom and for passing it to a papermaking machine, and processing means associated with the papermaking machine for processing the fibrous material to form a base sheet of reconstituted tobacco and impregnating the sheet with a concentrate of the water soluble components separated in the extraction stage.

17. The invention in accordance with claim 16 wherein two peg-mill deflakers are employed.

18. The invention in accordance with claim 17 wherein the diluted slurry passed to the papermaking machine is initially passed to the head box of the machine where the slurry is passed onto a moving foraminous belt moving at low speed to permit a larger percentage of the water retained by the deposited fiber to drain out through the moving belt, suction members apply suction to remove further water from the fibrous mat on the belt, at the end of the belt a felt belt is pressed down upon the fibrous sheet, the sheet sticking to the underside of the felt belt, a second felt belt is brought into contact with the underside of the fibrous sheet after the sheet passes from the belt thereby sandwiching the sheet between the two felt belts, the fiber sheet between the two felt belts is then passed through two sets of horizontal pressure rollers which squeeze moisture from the sheet so as to reduce the moisture level of the sheet from approximately 90 percent by weight to about 72 percent by weight, thereafter the sheet is transferred from the felt belts to a first dryer in the form of a large slowly rotating cylinder heated to a surface temperature of approximately 120 degrees centigrade, the drum of the first dryer is depressed below the pressure rollers and the sheet moves beneath the first dryer drum thereby relieving some of the tension on the sheet, the sheet at a moisture content of 50–60 percent by weight is passed through a series of rollers after it exits from the first dryer and has a reduced moisture content to about 30 percent and then downward between to opposed rollers where the sheet is impregnated with the concentrate obtained from the extractor system so that the sheet absorbs the extract as it passes through the rollers thereby increasing the moisture content to approximately 45 percent, thereafter the sheet is moved sequentially through a tunnel dryer, in which it is supported by air to prevent sticking and dried to a moisture content of 17 to 20 percent by weight, a threshing machine and a rotary dryer whereupon the dried reconstituted tobacco having a moisture content of 10 to 15 percent is conveyed to a collection area for packaging.

19. The invention in accordance with claim 17 wherein the extractor stage includes three separate extractors of the type for removing extract from the solid material by moving the solid material by means of a rotating screw feeder through a conical section of progressively decreasing cross section having perforated walls.

20. The invention in accordance with claim 17 wherein the extractor stage includes three separate extractors, means for passing the extract from the first extractor through two successive sieves for removal of some of the suspended solids therein, means for feeding back the solids from the first sieve into the first extractor along with the slurry from the deflaker, means for passing the extract through the second sieve so that material of smaller size than that removed in the first sieve is removed and the material of smaller size is removed and, prior to refining, added to the extracted fibrous material leaving the extraction system.

21. The invention in accordance with claim 20 wherein the extract from the sieves is passed to a clarifier where further fines are removed and the refined extract is returned to the refined material, the partially extracted material is continuously fed to a second extractor and the material thus extracted is passed to a third extractor.

22. The invention in accordance with claim 21 wherein means is provided for passing the solids removed from the first extractor to a remix tank for holding the solids therein for approximately 2 minutes, means for mixing the extract from the third extractor with the solids from the first extractor in the remix tank prior to introduction to the second extractor, means for passing the slurry from the remix tank through the second extractor, means for returning the extract from the second extractor to be mixed with a predetermined amount of tobacco material introduced into the process before the deflaker, means for discharging the solids from the second extractor to the third extractor, means for feeding fresh water into the third extractor to contact the partially extracted solids received from the second extractor to extract further extractable material.

23. The invention in accordance with claim 16 wherein the slurry is pumped to the deflaker by means of a lobe rotor pump, the deflaker acting on the fiber bundles to reduce the cross section relative to their length in order to produce a reconstituted tobacco of good strength.

24. The invention in accordance with claim 16 wherein the refining means is a disc mill including a plurality of rotating discs which further separates the fibers.

* * * * *